US005757946A

United States Patent [19]

Van Schyndel

[11] Patent Number: 5,757,946

[45] Date of Patent: May 26, 1998

[54] MAGNETIC FLUID LOUDSPEAKER ASSEMBLY WITH PORTED ENCLOSURE

[75] Inventor: André John Van Schyndel, Kanata, Canada

[73] Assignee: Northern Telecom Limited, Montreal, Canada

[21] Appl. No.: 717,608

[22] Filed: Sep. 23, 1996

[51] Int. Cl.[6] ..... H04R 25/00

[52] U.S. Cl. ..... 381/199; 381/192; 381/194

[58] Field of Search ..... 381/194, 199, 381/205

[56] References Cited

U.S. PATENT DOCUMENTS

| | | | |
|---|---|---|---|
| 4,017,694 | 4/1977 | King | 179/115.5 VC |
| 5,335,287 | 8/1994 | Athanas | 381/197 |

*Primary Examiner*—Curtis Kuntz
*Assistant Examiner*—Rexford N. Barnie
*Attorney, Agent, or Firm*—Thomas Adams

[57] ABSTRACT

A miniature loudspeaker assembly comprises a loudspeaker drive unit housed in an enclosure. The drive unit comprises a magnet unit defining a magnetic air gap, a voice coil in the air gap, and a diaphragm coupled to and driven by the voice coil. Magnetic fluid is injected into the air gap to occupy interstices between the voice coil and the poles of the magnet unit. The enclosure has a volume between about one eighth and about double a compliance equivalent volume of the loudspeaker drive unit. Preferably, the enclosure volume is less than or equal to the compliance equivalent volume of the drive unit. The enclosure may have a port. The free space resonant frequency of the ported enclosure may be between about 50 percent and about 60 percent of the free space resonance frequency of the loudspeaker drive unit.

14 Claims, 4 Drawing Sheets

MAGNETIC FLUID LOUDSPEAKER ASSEMBLY WITH PORTED ENCLOSURE

FIELD OF THE INVENTION

This invention relates to loudspeaker assemblies and is especially applicable to loudspeaker assemblies in which a magnetic fluid is provided between the voice coil and the magnetic poles. The invention is especially concerned with small loudspeakers, for example loudspeakers of "hands-free" telephone sets, loudspeakers of multimedia personal computers, and so on.

BACKGROUND

Magnetic fluids comprise very fine magnetic particles suspended in a viscous liquid, such as an oil. Such magnetic fluids have been used in loudspeakers to carry heat away from the voice coil. This decreases the temperature rise in the voice coil for a given applied power (and hence the corresponding change in impedance), as well as increasing the maximum power handling capabilities of the loudspeaker. This is particulary beneficial for tweeters, where power handling is more often restricted by voice coil heating. In low frequency drivers, power handling is more often restricted by the suspension and voice coil characteristics required for large cone excursions, and less likely to be improved by magnetic fluid.

Loudspeakers using magnetic fluid have been disclosed in U.S. Pat. No. 5,335,287 (Athanas) issued August 1994 and U.S. Pat. No. 4,017,694 (King) issued April 1977, both of which are incorporated herein by reference. In a conventional loudspeaker, the diaphragm is attached to a voice coil former which carries the voice coil and extends into an annular cavity within the usual magnet assembly. The voice coil former is attached to the surrounding frame of the loudspeaker by a corrugated annular suspension. In designing the loudspeaker disclosed in U.S. Pat. No. 5,335,287, Athanas dispensed with the corrugated annular suspension and relied upon magnetic fluid to support the voice coil former and voice coil. Athanas focused upon venting arrangements to prevent displacement of the magnetic fluid.

U.S. Pat. No. 4,017,694 issued Apr. 12, 1977 discloses a loudspeaker drive unit of conventional configuration but with a magnetic fluid enveloping the voice coil. The magnetic fluid is introduced into the annular cavity which contains the voice coil and is retained there by the magnetic field. According to U.S. Pat. No. 4,017,694, providing the magnetic fluid has a viscosity between about 1000 centipoise and 10,000 centipoise, air gap underdamping of the loudspeaker drive unit is eliminated, leading to improved bass response. Also, it is claimed that the power rating of the loudspeaker drive unit can be increased 200% to 300% without introducing gross distortion and avoiding the use of heavy magnets. U.S. Pat. No. 4,017,694 also addresses dust cap venting to prevent hissing and possible displacement of the magnetic fluid. However, U.S. Pat No. 4,017,694 does not address the design of an enclosure for such a loudspeaker drive unit.

When designing an enclosure for a conventional loudspeaker, one may use computer modelling techniques operating with an equivalent circuit of the loudspeaker. Employing such techniques to design an enclosure for a loudspeaker with a magnetic fluid around the voice coil, I found that the techniques did not work properly and concluded that the magnetic fluid was not behaving as expected.

One of the problems encountered in designing loudspeakers for telephone sets, and other applications where size is restricted, is that the small enclosure size results in poor sound quality. It is generally accepted that, for optimum frequency response of a particular loudspeaker drive unit in a sealed enclosure, the volume of the enclosure must be much larger than the compliance equivalent volume of the loudspeaker drive unit itself, typically by at least a factor of four. At frequencies which are low compared with the resonant frequency of the loudspeaker drive unit, the sound pressure at an external point rises at 12 dB/octave. At high frequencies, the pressure is roughly constant (neglecting cone breakup, standing waves, and other resonances). At the resonant frequency of the loudspeaker drive unit, the pressure may rise a little above the high frequency asymptote depending upon the Q factor of the loudspeaker drive unit. When the volume of the enclosure is reduced, the effective resonant frequency increases because the back pressure of the air in the enclosure effectively stiffens the drive unit suspension. This increased resonant frequency reduces the effectiveness of the drive unit at low frequencies, in view of the "roll off" at 12 dB per octave. In addition, the Q factor of the system increases, resulting in a pressure increase at the resonant frequency. Both effects degrade performance.

Consequently, it is difficult to obtain good sound quality in telephone set loudspeakers, multimedia computer loudspeakers, and the like, where enclosure size is limited. Sound quality depends upon many factors, but generally designers try to obtain a substantially flat frequency response characteristic over a wide range of frequencies. Although adding magnetic fluid improves the frequency response of the drive unit, particularly at the resonant frequency, it does not necessarily follow that the performance will be the same when the drive unit is mounted in an enclosure. The magnetic fluid comprises small magnetic particles suspended in a viscous fluid. The magnetic field retains the fluid within the voice coil cavity. The presence of the viscous fluid between the voice coil and the magnet poles increases the damping. When designing an enclosure for such a loudspeaker drive unit with increased damping, a skilled person would expect to have to reduce the size of the enclosure in order to obtain a reasonably flat response. The reduced enclosure size would cause the lower frequency part of the frequency response to "roll off" at a higher frequency, decreasing performance at low frequencies.

I have discovered that, by taking the magnetic fluid characteristics into account when designing the enclosure, it is possible to design a loudspeaker enclosure which, for a given performance, is surprisingly smaller than expected.

SUMMARY OF THE INVENTION

According to one aspect of the present invention, a loudspeaker assembly comprises a loudspeaker drive unit having a magnet unit defining a magnetic air gap, a voice coil extending at least partly in the air gap and movable to and fro relative to the magnet unit, a magnetic fluid within the air gap and occupying interstices between the voice coil and the magnet unit, and a diaphragm coupled to and driven by the voice coil, the loudspeaker drive unit being housed in an enclosure having a volume between about one eighth and about double a compliance equivalent volume of the loudspeaker drive unit.

Preferably, the enclosure volume is less than, or equal to, the compliance equivalent volume of the loudspeaker drive unit.

The enclosure may have a port, in which case the loudspeaker may have a low frequency response extending significantly lower than the free space resonant frequency of the loudspeaker drive unit.

In preferred embodiments of the invention, where the enclosure has a port, the free space resonant frequency of the loudspeaker drive unit is between about 50 percent and about 60 percent, and preferably about one half, of the resonance frequency of the enclosure determined approximately according to the expression:

$$f_{ENC} \approx \frac{1}{2\pi} \sqrt{\frac{\rho c^2}{V_{AB} M_A}}$$

where $M_A$ is the acoustic inductance of the port, given approximately by the expression:

$$M_A = \frac{\rho l}{\pi a^2}$$

$\rho$ is the density of air ($\approx$1.18 kg/m$^3$);

a is the radius of the port (m);

l is the length of the port (m);

$V_{AB}$ is the internal volume of the enclosure (m$^3$);

c is the speed of sound ($\approx$344 m/S);

The parameters of the loudspeaker drive unit, magnetic fluid and enclosure preferably are predetermined such that $$\frac{\eta S}{A^2 L} \approx \sqrt{\frac{V_{AS} + V_{AB}}{\rho c^2 M_A}}$$

where $M_A$ is the acoustic inductance of the port, as above;

$V_{AB}$ is the volume of the enclosure (m$^3$)

$V_{AS}$ is the compliance equivalent volume of the loudspeaker drive unit (m$^3$);

$\eta$ is the viscosity of the magnetic fluid (Pa-S);

S is the voice coil surface area in contact with the magnetic fluid (m$^2$);

A is the area of the loudspeaker diaphragm (m$^2$);

L is the mean distance between the voice coil and the magnet poles (m); and $\rho$ is the density of air (kg/m$^3$).

According to a second aspect of the invention, a method of determining the parameters of the loudspeaker assembly comprises the step of deriving an effective impedance ZFF for the magnetic fluid as follows:

$$\text{Magnitude: } \frac{1}{A^2} \sqrt{Re(F)^2 + Im(F)^2} \quad Ns/m^5$$

$$\text{Phase: } \tan^{-1}\left(\frac{Im(F)}{Re(F)}\right)$$

where:

$$Re(F) = \eta S k \frac{\sinh 2kl + \sin 2kl}{\cosh 2kl - \cos 2kl}$$

$$Im(F) = -\eta S k \frac{\frac{\tanh kl}{\cos^2 kl} - \frac{\tan kl}{\cosh^2 kl}}{\tanh^2 kl + \tan^2 kl}$$

A is the surface area of the loudspeaker diaphragm (m$^2$)

$\eta$ is the viscosity of the magnetic liquid (Pa-s)

S is the voice coil surface area in contact with the magnetic liquid $$k = \frac{\sqrt{\omega \rho}}{2\eta}$$

p is the density of the magnetic liquid (kg/m$^3$) and l is the mean distance between the magnet and the voice coil (m).

An embodiment of the invention will now be described by way of example only and with reference to the accompanying drawings.

DESCRIPTION OF A PREFERRED EMBODIMENT

Figure 1:
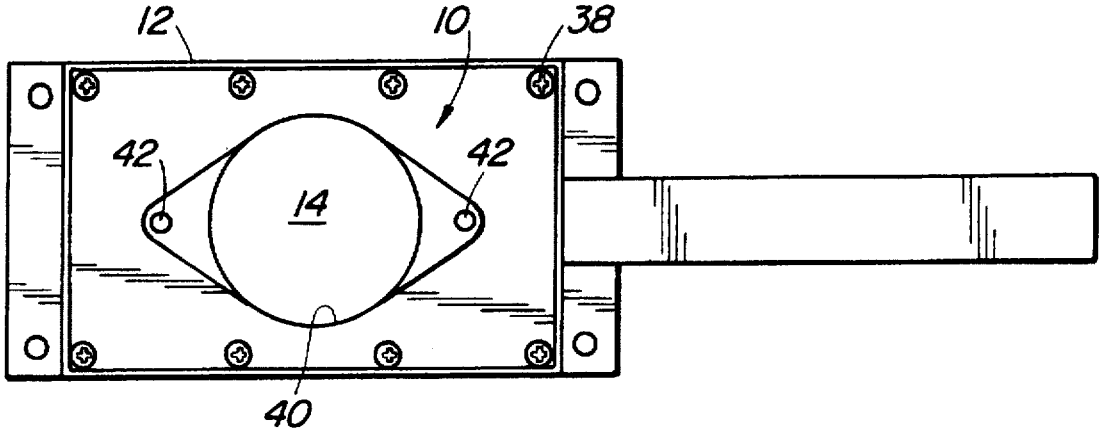
FIG. 1 is a plan view of a loudspeaker assembly embodying the present invention.
Figure 2:
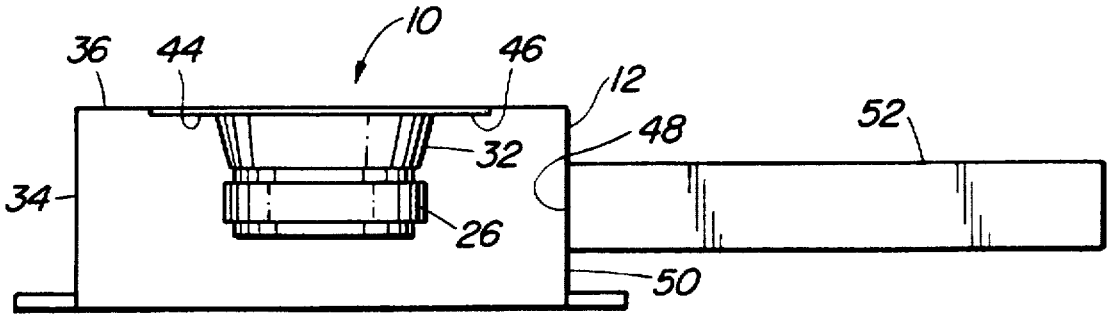
FIG. 2 is a sectional side view of the loudspeaker assembly.
Figure 3:
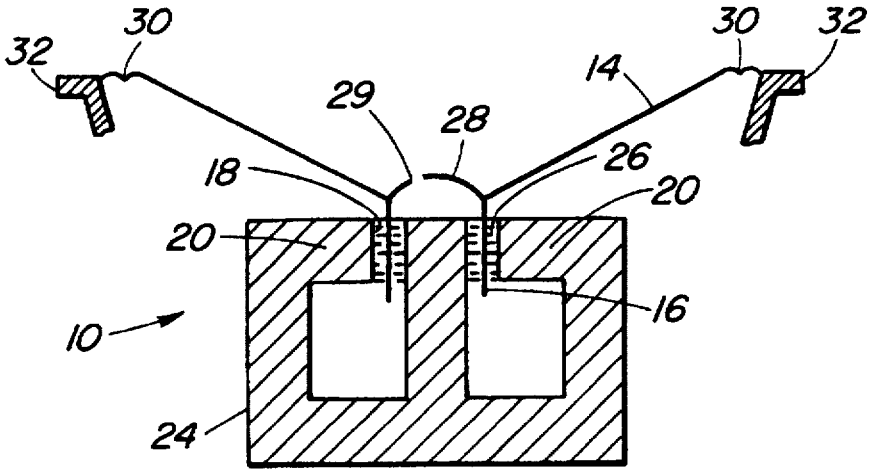
FIG. 3 is a schematic sectional view of the loudspeaker drive unit.

Referring to FIGS. 1, 2 and 3, a loudspeaker comprises a loudspeaker drive unit 10 housed in a parallelepiped enclosure 12. The drive unit 10 is of conventional construction in that it comprises a conical diaphragm 14 carried by a voice coil unit 16 which extends into an annular cavity 18 defined by opposed magnetic poles 20 and 22 of a magnet assembly 24. Magnetic fluid 26 is provided in the cavity 18, in the interstices between the voice coil unit 16 and the magnetic poles 20 and 22. A suitable magnetic fluid is marketed under the trade name Ferrofluid™ by Ferrofluidics Corporation, Nashua, N.H. The magnetic fluid may be inserted into the cavity using a syringe, as described in U.S. Pat. No. 4,017,694. A dust cap 28 with a small vent (not shown) spans the inner end of the conical diaphragm 14. A flexible surround 30, which extends around the outer rim of the conical diaphragm 14, attaches the diaphragm 14 to the support frame 32 of the drive unit 10. The construction of the loudspeaker drive unit may be as described in U.S. Pat. No. 4,017,694 and so will not be described in more detail here.

The enclosure 12 comprises an oblong, cast aluminum box 34 closed by a lid 36 which is secured to the box 34 by screws 38. The lid 36 is sealed to the rim of box 28 by a gasket (not shown) and has a central aperture 40. The loudspeaker drive unit 10 is attached to the inside of lid 36 by screws 42 which extend through aligned holes (not shown) in the lid 36 and flanges 44 and 46 of the support frame 32, the rim of the diaphragm 14 coinciding with the rim of aperture 40. A hole 48 is provided in one end wall 50 of the box 34. One end of a tube 52 is attached to the end wall 50 and communicates with the hole 48. The tube 52 extends, with its cylindrical axis coincident with the longitudinal central axis of box 34, away from the end wall 50 for a distance slightly greater than the length of the box 52. The tube 52 forms an acoustic port and may be made of aluminum or a synthetic plastics material.

In one practical embodiment, the drive unit 10 was a model TF050-A90822 by NMB Precision Incorporated, with about $1\times10^{-7}$ $m^3$ (100 microliters) of Ferrofluid™ with a viscosity of 1 Pa-s injected into its voice coil cavity. The box 34 was 108 mm. long by about 67 mm. wide and about 43 mm. deep, with a net internal volume, i.e. not including that occupied by the drive unit 10, of about 250 cc. The port tube 46 was 115 mm. long with an internal diameter of 16 mm.

Figure 4:
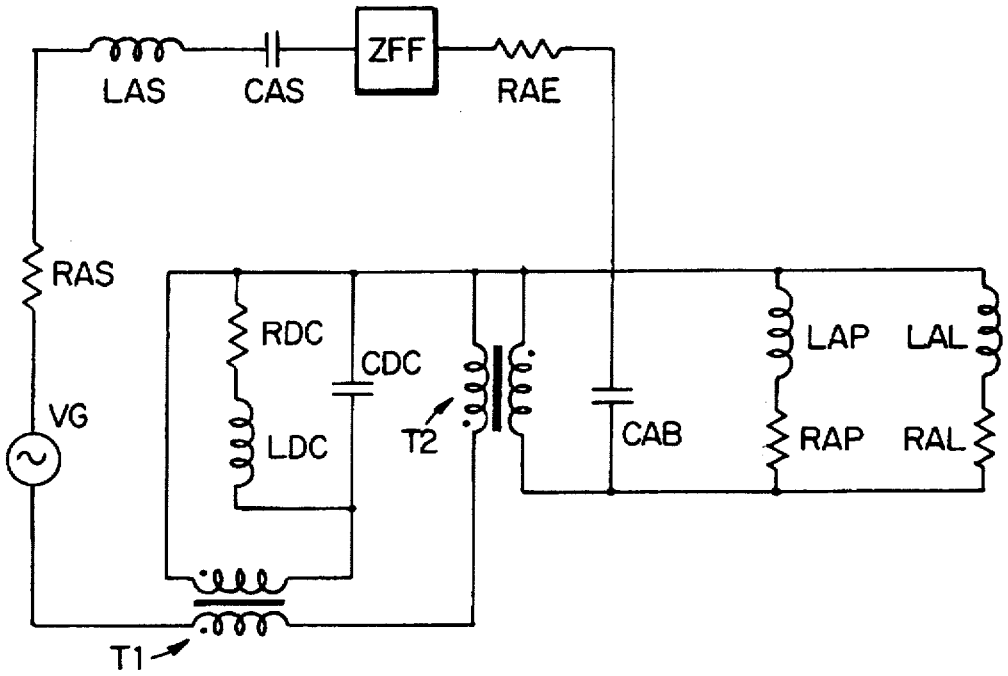
FIG. 4 is an equivalent circuit of the loudspeaker assembly used to model its performance.

These dimensions of the enclosure and port which optimized the acoustic performance of the loudspeaker were determined by a series of iterative computations using the parameters of the loudspeaker drive unit 10, the port 52 and the magnetic fluid 26 in an equivalent circuit for the loudspeaker system as shown in FIG. 4. In FIG. 4, the drive unit 10 is represented by the voltage source VG, resistance RAE for losses due to the electrical circuit, inductance LAS representing the mass of the diaphragm 14, capacitance CAS representing the compliance of the loudspeaker drive unit suspension and RAS representing mechanical losses. The magnetic fluid 26 is represented by complex impedance ZFF. Capacitance CDC represents the compliance of the cavity beneath the dust cap 28, RDC and LDC represent, resistance and inductance, respectively, of the vent 29 in the dust cap 28. LAP and RAP represent inductance LAP and resistance RAP represent the compliance of the port 52. Inductance LAL and resistance RAL represent leakage. CAB represents the compliance of the enclosure 12. Losses in the enclosure 12 are insignificant. The turns ratios of ideal transformers T1 and T2 are 1:(1+SC/SR) and 1:(1+SR/SC), respectively, where SC is the cross-sectional area of the volume swept by the dust cap 29; SR is the area of the diaphragm excluding the dust cap 29.

Figure 5:
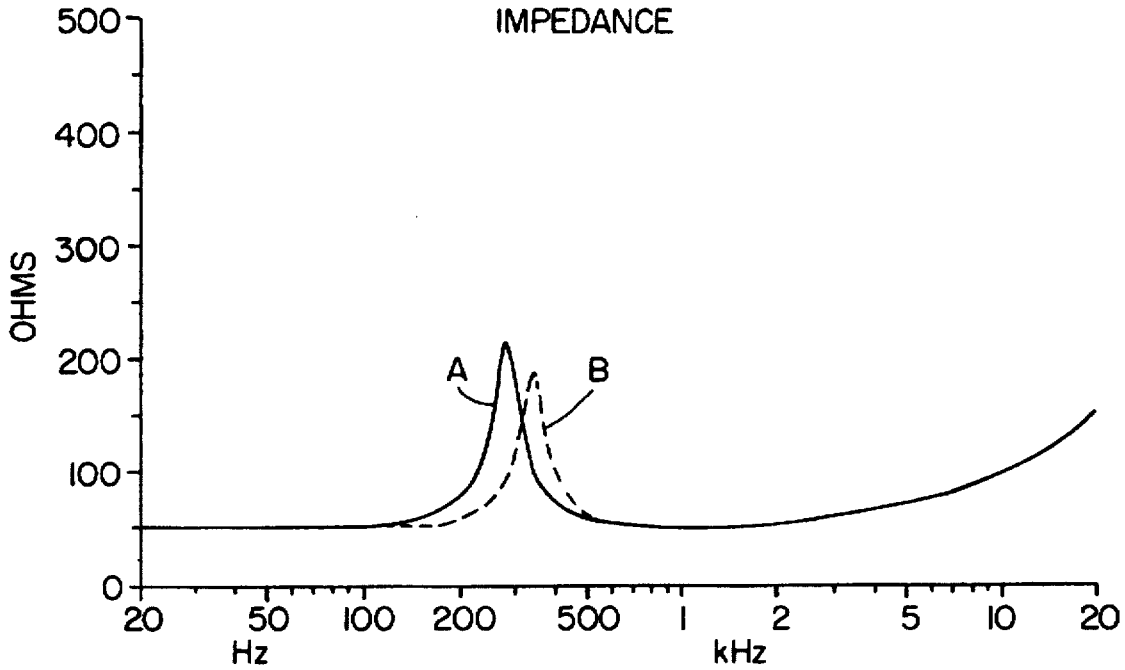
FIG. 5 shows plots of the electrical impedance of the loudspeaker drive unit.

The optimized dimensions were obtained as follows:

1. The electrical impedance of the loudspeaker drive unit was measured. The results are shown in FIG. 5, curve A showing the variation of impedance with frequency with the drive unit hanging in free space and curve B showing the variation of impedance with frequency with the drive unit in a sealed volume.
2. Available ranges of magnetic fluid parameters were determined, i.e. viscosity, density, magnetic susceptibility).
3. Commencing with an enclosure volume approximately equal to the compliance equivalent volume of the loudspeaker drive unit 10, and using the equivalent circuit shown in FIG. 4, the frequency response was calculated and plotted.
5. The various parameters were adjusted and the calculations repeated.
6. The above steps were repeated until a predetermined satisfactory frequency response was obtained.

The values of VG, RAE, RAS, LAS and CAS were derived from the electrical impedance curves shown in FIG. 4. The values of CDC, LDC, RDC and SC/CR were determined from the geometry of the loudspeaker drive unit 10. The values of RAP and LAP were derived from the geometry of the enclosure. The impedance ZFF for the magnetic fluid was derived from an analysis of the effects of magnetic liquid in the structure, as follows:

$$\text{Magnitude: } \frac{1}{A^2}\sqrt{Re(F)^2+Im(F)^2}\quad Ns/m^5$$

$$\text{Phase: } \tan^{-1}\left(\frac{Im(F)}{Re(F)}\right)$$

where:

$$Re(F)=\eta Sk\frac{\sinh 2kl+\sin 2kl}{\cosh 2kl-\cos 2kl}$$

$$Im(F)=-\eta Sk\frac{\dfrac{\tanh kl}{\cos^2 kl}-\dfrac{\tan kl}{\cosh^2 kl}}{\tanh^2 kl+\tan^2 kl}$$

A is the surface area of the loudspeaker diaphragm ($=1.45\times10^3$ $m^2$)

$\eta$ is the viscosity of the magnetic liquid (=1 Pa-s)

S is the voice coil surface area in contact with the magnetic liquid $$k=\frac{\sqrt{\omega\rho}}{2\eta}$$

$\rho$ is the density of the magnetic liquid (=1100 $Kg/m^3$)

l is the mean distance between the magnet and the voice coil ($0.225\times10^{-3}$m).

It should be noted that the magnetic fluid could be represented by an equivalent voltage source (EFF) rather than the impedance (ZFF). The value of the voltage source would be obtained by multiplying the impedance ZFF by the acoustic current/volume velocity $u_0$.

At the end of the process, optimized values had been determined for the frequency response of the final assembly, the volume of the enclosure, the dimensions of the port (radius and length), and the viscosity, density, volume and magnetic susceptibility of the magnetic fluid. It will be appreciated that the calculations were carried out using a computer. For the loudspeaker illustrated in FIGS. 1, 2 and 3, the final values were as follows:

| | |
|---|---|
| VG | $1.270\times10^2$ $N/m^2$ |
| RAE | $3.313\times10^5$ $Ns/m^5$ |
| LAS | $3.114\times10^2$ $kg/m^4$ |
| CAS | $1.011\times10^{-9}$ $m^5/N$ |
| RAS | $1.041\times10^5$ $Ns/m^5$ |
| CAB | $1.426\times10^{-9}$ $m^5/N$ |
| RAP | $2.389\times10^4$ $Ns/m^5$ |
| LAP | $7.841\times10^2$ $kg/m^4$ |
| CDC | $7.770\times10^{-12}$ $m^5/N$ |
| LDC | $2.295\times10^2$ $kg/m^4$ |
| RDC | $6.811\times10^5$ $Ns/m^5$ |
| SC/SR | 0.167 |

The magnetic fluid viscosities considered ranged between 0.05 Pa-s and 2.0 Pa-s, the actual value used being 1.0 Pa-s. The density of 1100 $kg/m^3$ did not change appreciably from one magnetic liquid to another. The susceptibility varied between 100 and 200 Gauss but, since it had a much smaller effect than variation of the viscosity, it was neglected in the calculations.

It should be appreciated that these parameters were arrived at for a particular drive unit and frequency response.

Figure 6:
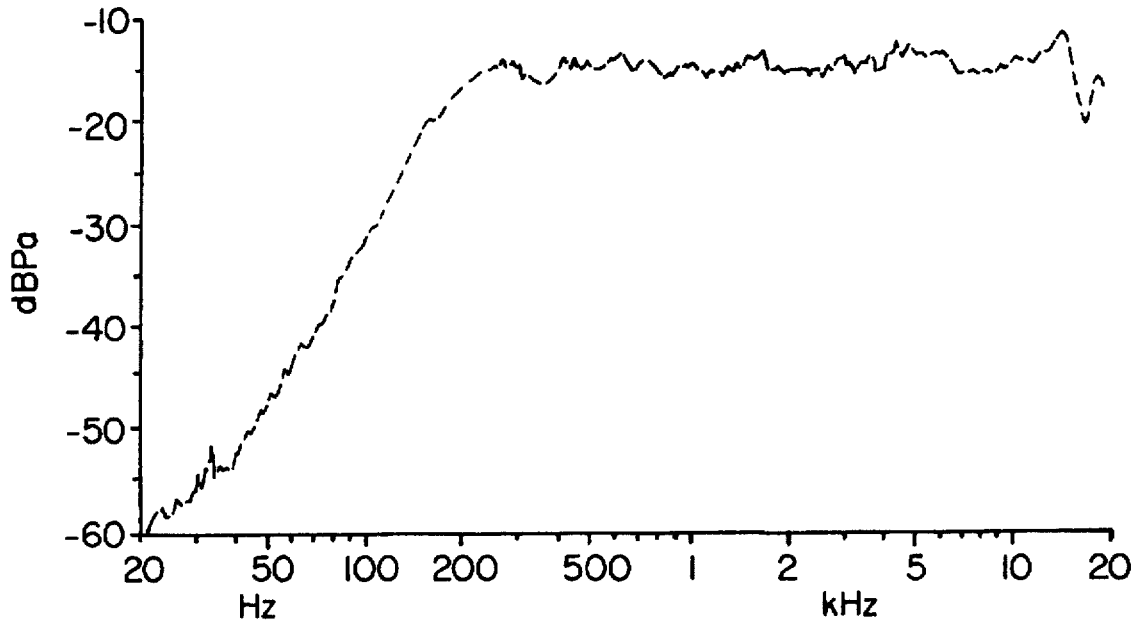
FIG. 6 shows the frequency response of the loudspeaker drive unit without magnetic fluid and on an IEC standard baffle.
Figure 7:
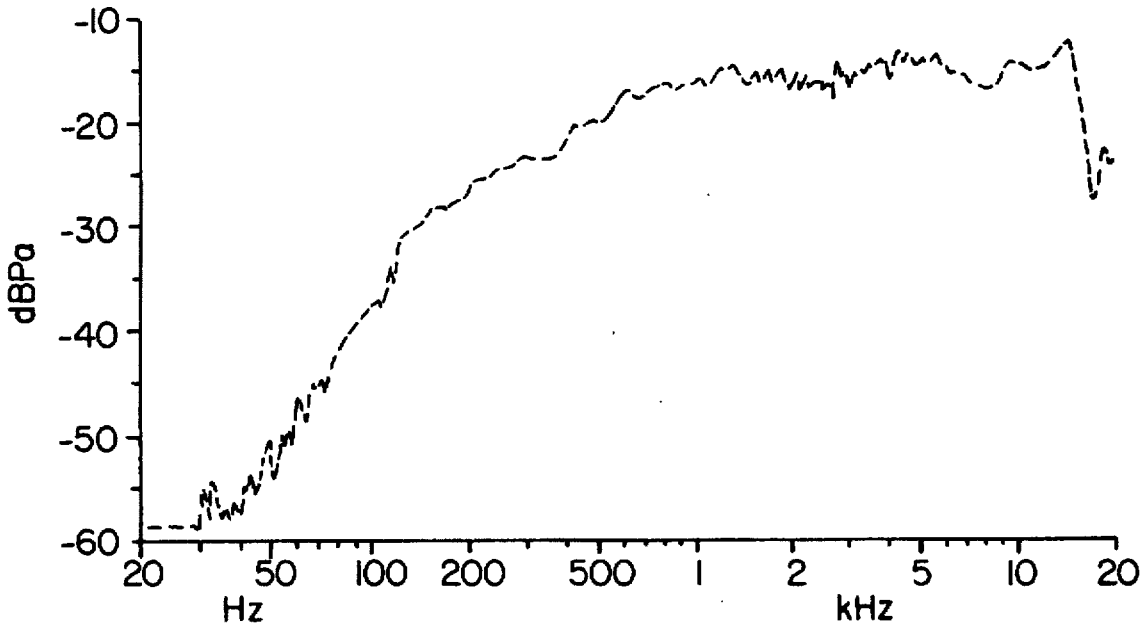
FIG. 7 shows the frequency response of the loudspeaker drive unit on the IEC standard baffle after the addition of magnetic fluid.
Figure 8:
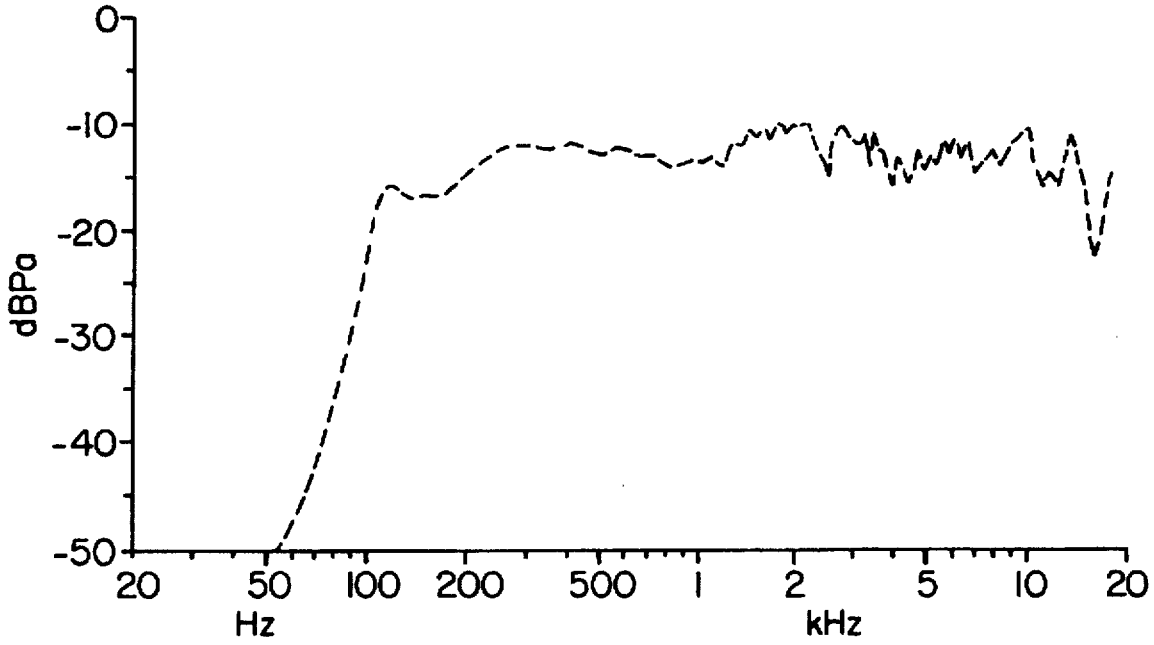
FIG. 8 shows the frequency response of the loudspeaker drive unit with magnetic fluid and mounted in a ported enclosure.

FIG. 6 shows the frequency response of the loudspeaker drive unit 10 without the magnetic fluid and on an IEC standard baffle. As shown in FIG. 7, addition of the magnetic liquid had the effect of "overdamping" the drive unit, resulting in a reduction in the response to the lower frequencies. It is generally known that a suitable enclosure, with a port, can restore the response at lower frequencies. However, in conventional loudspeaker units, the improvement is at the expense of a reduction in the uniformity of the frequency response, the effect being more pronounced as the enclosure size is reduced. As shown in FIG. 8, with the loudspeaker drive unit 10 mounted in the ported enclosure 12, the lower frequency response is restored. It is noticeable, however, that the frequency response curve in FIG. 8 does not show the usual high Q resonances one would expect from such a small enclosure. The reason for such surprisingly good results attained by embodiments of the present invention is not known precisely. It is thought, however, that it might be attributable, at least in part, to the fact that the magnetic fluid not only increases the damping, thereby reducing the high Q resonances, but also effectively increases the voice coil mass. Moreover, the change in mass is frequency dependent.

It should be appreciated that the above-described enclosure is of prototype construction. In practice, it could, and probably would, be made differently. For example, the port tube 52 might extend within the box 34.

What is claimed is:

1. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit.

2. A loudspeaker assembly as claimed in claim 1, wherein the enclosure volume is less than, or equal to, the compliance equivalent volume of the loudspeaker drive unit.

3. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit, wherein the enclosure has a port and the resonant frequency of the enclosure is between about 50 percent and about 60 percent of the free space resonance frequency of the loudspeaker drive unit, the resonant frequency of the enclosure being determined approximately by the expression:

$$f_{ENC} \approx \frac{1}{2\pi}\sqrt{\frac{\rho c^2}{V_{AB}M_A}}$$

where $M_A$ is the acoustic inductance of the port, given approximately by the expression:

$$M_A = \frac{\rho l}{\pi a^2}$$

$\rho$ is the density of air ($\approx$1.18 kg/m$^3$);

a is the radius of the port (m);

l is the length of the port (m);

$V_{AB}$ is the internal volume of the enclosure (m$^3$);

c is the speed of sound ($\approx$344 m/S).

4. A loudspeaker assembly as claimed in claim 3, wherein the resonance frequency of the enclosure is about one half of the free space resonance frequency of the loudspeaker drive unit.

5. A loudspeaker assembly as claimed in claim 3, wherein the enclosure has a port and the resonant frequency of the enclosure is between about 50 percent and about 60 percent of the free space resonance frequency of the loudspeaker drive unit, the resonant frequency of the enclosure being determined approximately by the expression:

$$f_{ENC} \approx \frac{1}{2\pi}\sqrt{\frac{\rho c^2}{V_{AB}M_A}}$$

where $M_A$ is the acoustic inductance of the port, given approximately by the expression:

$$M_A = \frac{\rho l}{\pi a^2}$$

$\rho$ is the density of air ($\approx$1.18 kg/m$^3$);

a is the radius of the port (m);

l is the length of the port (m);

$V_{AB}$ is the internal volume of the enclosure (m$^3$);

c is the speed of sound ($\approx$344 m/S).

6. A loudspeaker assembly as claimed in claim 4, wherein the resonance frequency of the enclosure is about one half of the free space resonance frequency of the loudspeaker drive unit.

7. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit, wherein the parameters of the loudspeaker drive unit, magnetic fluid and enclosure are predetermined such that $$\frac{\eta S}{A^2 L} \approx \sqrt{\frac{V_{AS} + V_{AB}}{\rho c^2 M_A}}$$

where $M_A$ is the acoustic inductance of the port, given approximately by the expression:

$$M_A = \frac{\rho l}{\pi a^2}$$

$V_{AS}$ is the compliance equivalent volume of the loudspeaker drive unit (m$^3$);

$V_{AB}$ is the volume of the enclosure (m$^3$);

$\eta$ is the viscosity of the magnetic fluid (Pa-s);

S is the voice coil surface area in contact with the magnetic fluid (m$^2$);

A is the area of the loudspeaker diaphragm (m$^2$);

L is the mean distance between the voice coil and the magnet poles (m); and $\rho$ is the density of air (kg/m$^3$).

8. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit, wherein the enclosure volume is less than, or equal to, the compliance equivalent volume of the loudspeaker drive unit and the parameters of the loudspeaker drive unit, magnetic fluid and enclosure are predetermined such that $$\frac{\eta S}{A^2 L} \approx \sqrt{\frac{V_{AS}+V_{AB}}{\rho c^2 M_A}}$$

where $M_A$ is the acoustic inductance of the port, given approximately by the expression:

$$M_A = \frac{\rho l}{\pi a^2}$$

$V_{AS}$ is the compliance equivalent volume of the loudspeaker drive unit ($m^3$);

$V_{AB}$ is the volume of the enclosure ($m^3$);

$\eta$ is the viscosity of the magnetic fluid (Pa-s);

S is the voice coil surface area in contact with the magnetic fluid ($m^2$);

A is the area of the loudspeaker diaphragm ($m^2$);

L is the mean distance between the voice coil and the magnet poles (m); and $\rho$ is the density of air ($kg/m^3$).

9. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit, wherein the enclosure has a port and the resonant frequency of the enclosure is between about 50 percent and about 60 percent of the free space resonance frequency of the loudspeaker drive unit, the resonant frequency of the enclosure being determined approximately by the expression:

$$f_{ENC} \approx \frac{1}{2\pi}\sqrt{\frac{\rho c^2}{V_{AB} M_A}}$$

where $M_A$ is the acoustic inductance of the port, given approximately by the expression:

$$M_A = \frac{\rho l}{\pi a^2}$$

and the parameters of the loudspeaker drive unit, magnetic fluid and enclosure are predetermined such that $$\frac{\eta S}{A^2 L} \approx \sqrt{\frac{V_{AS}+V_{AB}}{\rho c^2 M_A}}$$

where $\rho$ is the density of air ($\approx 1.18$ $kg/m^3$);

a is the radius of the port (m);

l is the length of the port (m);

c is the speed of sound ($\approx 344$ m/S).

$V_{AS}$ is the compliance equivalent volume of the loudspeaker drive unit ($m^3$);

$V_{AB}$ is the volume of the enclosure ($^3$);

$\eta$ is the viscosity of the magnetic fluid (Pa-s);

S is the voice coil surface area in contact with the magnetic fluid ($m^2$);

A is the area of the loudspeaker diaphragm ($m^2$); and

L is the mean distance between the voice coil and the magnet poles (m).

10. A loudspeaker assembly comprising a loudspeaker drive unit housed in an enclosure, the drive unit comprising a magnet unit defining a magnetic air gap, a voice coil extending at least partly in the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker unit, wherein the enclosure has a port and the resonance frequency of the enclosure is about one half of the free space resonance frequency of the loudspeaker drive unit, the resonant frequency of the enclosure being determined approximately by the expression:

$$f_{ENC} \approx \frac{1}{2\pi}\sqrt{\frac{\rho c^2}{V_{AB} M_A}}$$

where $M_A$ is the acoustic inductance of the port, given approximately by the expression:

$$M_A = \frac{\rho l}{\pi a^2}$$

and the parameters of the loudspeaker drive unit, magnetic fluid and enclosure are predetermined such that $$\frac{\eta S}{A^2 L} \approx \sqrt{\frac{V_{AS}+V_{AB}}{\rho c^2 M_A}}$$

where $\rho$ is the density of air ($\approx 1.18$ $kg/m^3$);

a is the radius of the port (m);

l is the length of the part (m);

c is the speed of sound ($\approx 344$ m/S).

$V_{AS}$ is the compliance equivalent volume of the loudspeaker drive unit ($m^3$);

$V_{AB}$ is the volume of the enclosure ($m^3$);

$\eta$ is the viscosity of the magnetic fluid (Pa-s);

S is the voice coil surface area in contact with the magnetic fluid ($m^2$);

A is the area of the loudspeaker diaphragm ($m^2$); and

L is the mean distance between the voice coil and the magnet poles (m).

11. A method of determining parameters for a loudspeaker assembly comprising a loudspeaker drive unit housed in an enclosure, the drive unit comprising a magnet unit defining a magnetic air gap, a voice coil extending at least partly into the air gap, a magnetic fluid within the air gap and occupying interstices between the voice coil and the magnet unit, and a diaphragm coupled to and driven by the voice coil, the enclosure having a volume between about one eighth and about double a compliance equivalent volume of the loudspeaker drive unit, the method comprising the step of deriving an effective impedance ZFF for the magnetic fluid as follows:

$$\text{Magnitude: } \frac{1}{A^2}\sqrt{Re(F)^2+Im(F)^2}\ Ns/m^5$$

$$\text{Phase: } \tan^{-1}\left(\frac{Im(F)}{Re(F)}\right)$$

where:

$$Re(F)=\eta Sk\frac{\sinh 2kl+\sin 2kl}{\cosh 2kl-\cos 2kl}$$

$$Im(F)=-\eta Sk\frac{\frac{\tanh kl}{\cos^2 kl}-\frac{\tan kl}{\cosh^2 kl}}{\tanh^2 kl+\tan^2 kl}$$

A is the surface area of the loudspeaker diaphragm ($m^2$)

η is the viscosity of the magnetic liquid (Pa-s)

S is the voice coil surface area in contact with the magnetic liquid $$k=\frac{\sqrt{\omega\rho}}{2\eta}$$

ρ is the density of the magnetic liquid ($kg/m^3$); and l is the mean distance between the magnet and the voice coil (m).

12. A method as claimed in claim 11, further comprising the step of determining a resonant frequency of the enclosure approximately according to the expression:

$$f_{ENC}\approx\frac{1}{2\pi}\sqrt{\frac{\rho c^2}{V_{AB}M_A}}$$

where $M_A$ is the acoustic inductance of the port, given approximately by the expression:

$$M_A=\frac{\rho l}{\pi a^2}$$

ρ is the density of air (≈1.18 $kg/m^3$);

a is the radius of the port (m);

l is the length of the port (m);

$V_{AB}$ is the internal volume of the enclosure ($m^3$);

c is the speed of sound (≈344 m/S).

13. A method as claimed in claim 11, wherein the parameters are determined such that $$\frac{\eta S}{A^2L}\approx\sqrt{\frac{V_{AS}+V_{AB}}{\rho c^2 M_A}}$$

where $M_A$ is the acoustic inductance of the port, given approximately by the expression:

$$M_A=\frac{\rho l}{\pi a^2}$$

$V_{AS}$ is the compliance equivalent volume of the loudspeaker drive unit ($m^3$);

$V_{AB}$ is the volume of the enclosure ($m^3$);

η is the viscosity of the magnetic fluid (Pa-s);

S is the voice coil surface area in contact with the magnetic fluid ($m^2$);

A is the area of the loudspeaker diaphragm ($m^2$);

L is the mean distance between the voice coil and the magnet poles (m); and

ρ is the density of air ($kg/m^3$).

14. A method as claimed in claim 11, wherein a resonant frequency of the enclosure is determined approximately according to the expression:

$$f_{ENC}\approx\frac{1}{2\pi}\sqrt{\frac{\rho c^2}{V_{AB}M_A}}$$

where $M_A$ is the acoustic inductance of the port, given approximately by the expression:

$$M_A=\frac{\rho l}{\pi a^2}$$

and the parameters are determined such that $$\frac{\eta S}{A^2L}\approx\sqrt{\frac{V_{AS}+V_{AB}}{\rho c^2 M_A}}$$

where

ρ is the density of air (≈1.18 $kg/m^3$);

a is the radius of the port (m);

l is the length of the port (m);

c is the speed of sound (≈344 m/S).

$V_{AS}$ is the compliance equivalent volume of the loudspeaker drive unit ($m^3$);

$V_{AB}$ is the volume of the enclosure ($m^3$);

η is the viscosity of the magnetic fluid (Pa-S);

S is the voice coil surface area in contact with the magnetic fluid ($m^2$);

A is the area of the loudspeaker diaphragm ($m^2$); and L is the mean distance between the voice coil and the magnet poles (m).

* * * * *